United States Patent [19]

Huser et al.

[11] 4,243,229

[45] Jan. 6, 1981

[54] GAME APPARATUS

[76] Inventors: Melvin Huser, 7400 Dos Rios Way; Clete Harper, 4124 Granada Ave., both of Bakersfield, Calif. 93309

[21] Appl. No.: 5,328

[22] Filed: Jan. 22, 1979

[51] Int. Cl.[3] ..... A63B 67/06

[52] U.S. Cl. ..... 273/402

[58] Field of Search ..... 273/105 R, 103, 102 S, 273/95 E, 95 R, 101, 102 R, 398–402

[56] References Cited

U.S. PATENT DOCUMENTS

| | | | |
|---|---|---|---|
| 608,918 | 8/1898 | Scovell . | |
| 1,636,920 | 7/1927 | Nichols . | |
| 2,050,914 | 8/1936 | Anderson | 273/102 S X |
| 2,905,471 | 9/1959 | Kinney, Jr. | |
| 2,905,472 | 9/1959 | Kinney, Jr. | |
| 3,561,762 | 2/1971 | Russell | 273/103 |
| 3,628,793 | 12/1971 | Mudloff | 273/105 R |
| 4,030,760 | 6/1977 | Danowski | 273/95 E |

FOREIGN PATENT DOCUMENTS

| | | | |
|---|---|---|---|
| 1249216 | 10/1971 | United Kingdom | 273/95 E |

*Primary Examiner*—Paul E. Shapiro

*Attorney, Agent, or Firm*—Wells, St. John & Roberts

[57] ABSTRACT

A game apparatus comprising a plurality of circular disks and a target. The target is constructed in the form of an upright backboard having a transverse front surface intersected by an inclined playing board. The back edge of the playing board is attached to the backboard at an elevation intermediate the top edge and bottom edge of the backboard. The top surface of the playing board forms an angle of slightly greater than 90° relative to the front surface of the backboard. The bottom edge of the backboard and front edge of the playing board rest freely on a supporting playing surface with the top edge of the backboard in a transverse horizontal position. A central target aperture through the playing board is dimensioned so as to permit the disks to fall through the aperture. The disks can come to rest on the top surface of the backboard, or on the top surface of the playing board. They also can lean between the top surface and front surface or fall through the aperture. The backboard can be rocked rearwardly to lift the front edge of the playing board for scoring of disks on its top surface.

5 Claims, 7 Drawing Figures

GAME APPARATUS

BACKGROUND OF THE INVENTION

This invention relates generally to games similar to the game of horseshoes. Horsehoses is basically an outdoor game, played with metal shoes thrown toward a pit having a heavy metal spike or post about which the shoes are scored. It requires a specialized outdoor throwing area. It also involves a measure of danger, particularly to children or other persons in the vicinity who might not be aware of the heavy shoes being thrown in their direction.

The present game can be played indoors or out, and does not involve the throwing of an article having dangerous weight. The projectile is in the form of a disk, which has rounded edges. The game can be played by persons of all ages, and involves no special training or skills to master it.

DESCRIPTION OF THE PREFERRED EMBODIMENT

Figure 1:
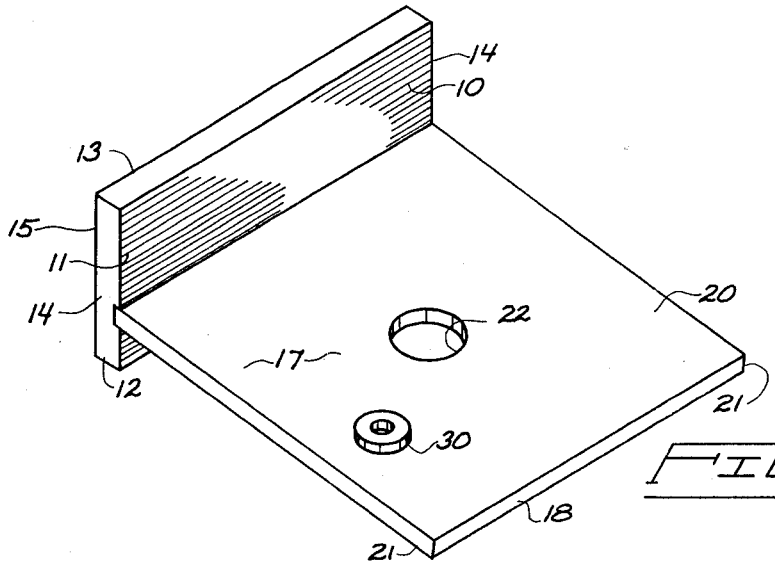
FIG. 1 is a front perspective view of the target and a disk.
Figure 2:
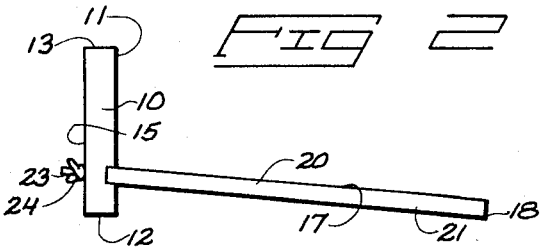
FIG. 2 is a side elevation view of the target.
Figure 3:
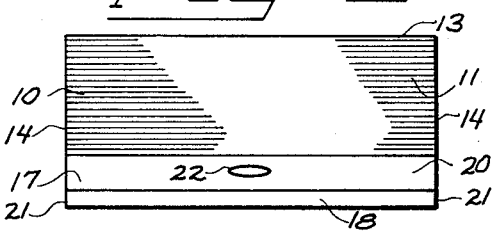
FIG. 3 is a front elevation view of the target.
Figure 4:
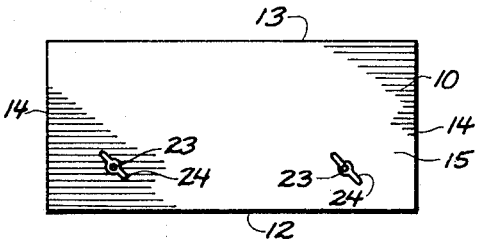
FIG. 4 is a rear elevation view of the target.
Figure 5:
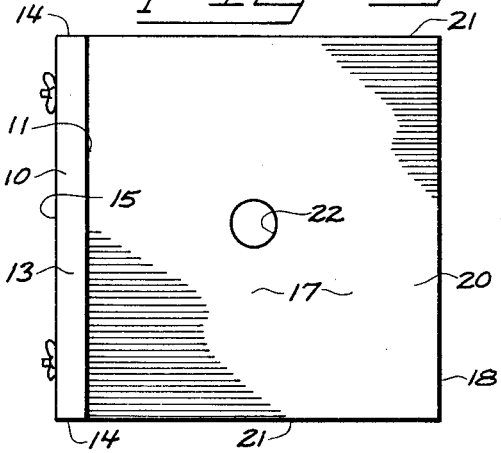
FIG. 5 is a top view illustrating several possible positions of a disk on the target.

The game apparatus basically comprises a plurality of circular disks 30, which are shown in the form of metal annular washers, and a target comprising an upright transverse backboard 10 and a forwardly inclined playing board 20. The disks 30 are thrown by the players in the direction of the target. The game is played by two players or teams. Each player or team stands behind one of the targets and throws at the other.

The target can be placed on any available supporting playing surface. When used indoors, the playing surface might be a wood floor, a concrete floor, or a floor having a covering such as tile or carpeting. When used outdoors, the playing surface might be soil, lawn, concrete or any covered or uncovered surface that is substantially horizontal.

The disks are preferably made from steel alloy. A typical disk might have an outside diameter of 2½ inches, an inside diameter of 1 inch and a thickness of 5/32 inch. The target is preferably made from natural hardwood. The backboard 10 might be 1½ inches thick, 7¼ inches high and 16 inches wide. The playing board 20 is 16 inches square.

The backboard 10 is fabricated from a rectangular board. It has a vertical front surface 11 extending between a horizontal bottom edge 12 and a parallel horizontal top edge 13. The bottom edge 12 of the backboard 10 is adapted to rest upon the supporting playing surface. The top edge 13 is perpendicular to its front surface 11 and extends the full width of the backboard 10. The parallel side edges 14 of backboard 10 lie within vertical planes.

The back surface 15 of backboard 10 is not used for playing purposes, but is parallel to the front surface 11.

Fixed to the front of backboard 10 is a forwardly inclined playing board 20. It includes an upwardly facing plane top surface 17 which is square. The playing board 20 intersects backboard 10 at an elevation intermediate its top edge 13 and bottom edge 12. The side edges 21 of the playing board 20 are in planes common to the side edges 14 of backboard 10. In the illustrated example, the top surface 17 intersects the front surface 11 at an angle slightly greater than 90°, specifically at an angle of 95°. The front edge 18 of the playing board 20 is adapted to rest on the supporting playing surface. With the previously given dimensions, this maintains the backboard 10 in a vertical condition during use of the target resting freely on a horizontal playing surface.

The playing board 20 includes a central circular 22 formed through it. The aperture 22 has cylindrical sides centered about a central axis perpendicular to the top surface 17. The diameter of the aperture 22 should be slightly greater than the outside diameter of disks 30. It should also be complementary to the outside shape of the disks 30. Using 2½ inch diameter disks, the aperture 22 should preferably be about 2¾ inches in diameter.

The playing board 20 is releasably fixed to the backboard 10 by a pair of screw-studs 23 fixed within the rear edge of the playing board 20. This rear edge is received along a rabbet cut across the front surface 11 parallel to the top edge 13. The screw-studs 23 are receivable through apertures extending through the base of the rabbet, and are releasably held in place by threaded wing nuts 24. It can be seen that the target can be readily assembled or disassembled for storage and traveling purposes.

Figure 6:
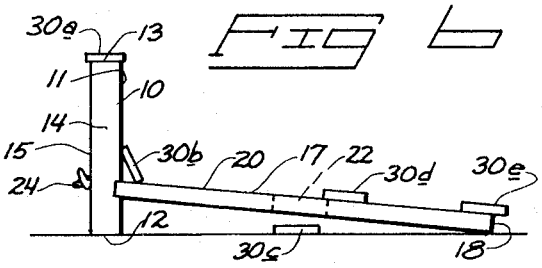
Figure 7:
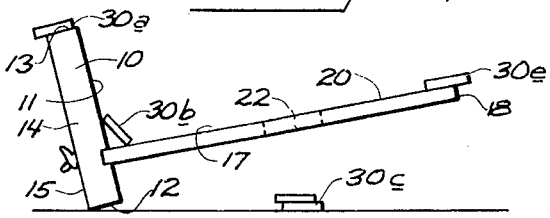
FIG. 7 is a view similar to FIG. 6, showing scoring of the disks by rocking of the target.

FIGS. 6 and 7 illustrate several alternatives for scoring the position of the disks 30 on the target. The disk **30*a* (FIG. 6) is balanced on the top edge 13 of the backboard 10. The disk 30*b* is leaning between the backboard 10 and the playing board 20. Disk 30*c* has fallen through the aperture 22. Disk 30*d* is leaning against the edge of the aperture 22. Disk 30*e* is balanced on the front edge 18 of the playing board 20. The first three disks 30*a*, 30*b*, and 30*c* might be scored as ten points, two points and five points respectively in a game based upon a total of 21** points to win. These scores are weighted as to the probability of achieving the various disk positions when throwing the disks at the target.

To score disks **30*d* and 30*e*, it is necessary to lift the front edge 18 from the supporting playing surface by slightly rocking the backboard 10 in a rearward direction as shown in FIG. 7. If the disk 30*d* then falls through the aperture 22, it is scored in a manner identical to those disks that fall through the aperture when thrown. If it remains on the playing board 20, it is scored as one point. If the disk 30*e* balances and remains on the playing board 20, it is scored as one point. If it falls from the playing board 20, it is not scored. Similarly, any disks leaning between the playing board 20** and the playing surface will fall onto the playing surface when the front edge of the playing board is lifted and will then not count toward the score.

To play the game, each player throws a maximum of eight disks toward the target. The player may choose to throw less than the total number if he wishes to accept his score at any time during his turn. All scoring that requires lifting of the front surface 18 can only be done at the completion of the player's turn.

Having described our invention, we claim:

1. In a game apparatus:

the combination of:

a plurality of circular disks each having a common outer diameter;

and a target comprising:

an upright rectangular backboard having a transverse front vertical surface extending between a bottom edge adapted to rest upon a supporting playing surface and an upwardly facing horizontal top edge, the thickness of the backboard across said top edge being greater than one half the outer diameter of said disks;

a square playing board fixed across the front surface of the backboard and having a planar top surface extending forwardly therefrom to a front edge that is adapted to rest on the supporting playing surface;

said playing board intersecting the front surface of the backboard intermediate its top and bottom edges, whereby the top surface of the playing board is forwardly inclined when the target is resting on the supporting playing surface;

and a circular target aperture formed through the top surface of said playing board at the center thereof, the inside diameter of said aperture being slightly greater than the outer diameter of said disks so as to freely pass circular disks dropped therein.

2. A game apparatus as set out in claim 1 wherein the angle between the front surface of the backboard and the top surface of the playing board is slightly greater than 90°.

3. A game apparatus as set out in claim 1 wherein the backboard and playing board are equal in width and wherein the respective side edges of each lie in common vertical planes.

4. A game apparatus as set out in claim 1 wherein the playing board is releasably connected to said backboard.

5. A game apparatus as set out in claim 1 wherein the front edge of the playing board lies in a plane perpendicular to its top surface.

* * * * *